US005819557A

United States Patent [19]

Bonchek

[11] Patent Number: 5,819,557

[45] **Date of Patent: *Oct. 13, 1998**

[54] PINHOLE ARTICLE OF JEWELRY

[76] Inventor: Herschel Bonchek, 41 Rechov Hakablan, Apt. 6, Har Nof 93874, Israel

[ * ] Notice: The term of this patent shall not extend beyond the expiration date of Pat. No. 5,806,345.

[21] Appl. No.: 979,036

[22] Filed: Nov. 26, 1997

Related U.S. Application Data

[63] Continuation of Ser. No. 658,707, Jun. 5, 1996.

[51] Int. Cl.[6] ..... A44C 25/00

[52] U.S. Cl. ..... 63/29.1; 63/23; 63/40

[58] Field of Search ..... 63/20, 22, 23, 63/26, 27, 29.1, 30, 40; 29/10, 896.4, 896.41

[56] References Cited

U.S. PATENT DOCUMENTS

| | | | |
|---|---|---|---|
| 1,091,539 | 3/1914 | Schrink | 63/29.1 |
| 1,649,540 | 11/1927 | Moscini . | |
| 1,889,862 | 12/1932 | Kessler | 63/29.1 |
| 2,018,079 | 10/1935 | Macioci | 63/29.1 |
| 4,809,416 | 3/1989 | Poltash | 29/896.41 |
| 5,357,770 | 10/1994 | Lanyi | 63/29.1 |

*Primary Examiner*—Kien T. Nguyen

*Attorney, Agent, or Firm*—Renner, Otto, Boisselle & Sklar, P.L.L.

[57] ABSTRACT

A piece of jewelry is provided which includes a base and at least one ornamental member. When the piece of jewelry is in an unassembled state, the ornamental member is detached from the base. The ornamental member includes a pair of elongate pins which are insertable into a pair of openings in the base and foldable to folded relation facing towards each other thereby firming fixing the ornamental member to the base to constitute an assembled piece of jewelry.

16 Claims, 2 Drawing Sheets

PINHOLE ARTICLE OF JEWELRY

This is a continuation, division, of application Ser. No. 08/658,707, filed Jun. 5, 1996 still pending.

FIELD OF THE INVENTION

The present invention relates to finger rings generally and more particularly to the assembly of receptacle pin rings which include a preset stone or stones.

BACKGROUND OF THE INVENTION

Receptacle pin rings, in particular receptacle pin rings which include precious or semi-precious stones, birthstones or an imitation thereof, are well known and popular ornamental objects.

Conventionally, the assembly of a receptacle pin ring which includes a stone is performed by a goldsmith and involves setting the stone in a fixed setting which forms an integral part of the ring band itself. Therefore, the custom setting of a stone in such a ring is a relatively costly and time consuming process usually done by a trained goldsmith.

For many jewelry stores, the goldsmith is not an integral part of the store and thus, if a customer desires that a certain stone be set in a certain setting, the stone and setting must be sent out to the goldsmith to be prepared, a process which can take a few weeks.

This is particularly bothersome for a customer who wants to buy a couple's ring which consists of a ring band which has the couple's birthstones set into it. There are many different combinations of two birthstones and it is too expensive for any store to stock more than a few of the many thousands of possible colored stone combinations. A similar story exists for mother's rings which are rings with the birthstones of the children of one mother. Thus, since all stone combinations cannot be stocked by a retailer, both the couple's ring and the mother's rings must be specially ordered from a goldsmith.

It is known to use screws to fix a stone on to a ring. However, the screws have a tendency to work loose and are hard to manipulate to secure the stone to the ring.

SUMMARY OF THE INVENTION

An important object of the present invention is to provide a receptacle pin ring with a preset stone the preset stone of which may be easily fixed into the ring and changed as desired.

According to the present invention, a receptacle pin ring may be assembled by a retailer or anyone not necessarily a skilled person. A ring may be tailored and custom made "while you wait", i.e. within a relatively short time period spent by the customer in a shop.

Also, the receptacle pin rings of the present invention may be assembled and disassembled by the ring's owner so he can exchange the stone or stones of his receptacle pin ring as desired.

The present inventor has realized that by separating the preset stone from the ring's base, a modular finger ring is provided, i.e. a receptacle pin ring in which on the same base a number of stones, each having its setting may be placed and changed as desired.

There is thus provided a receptacle pin ring which includes a ring band having at least one base, the base having at least one opening therethrough, at least one receptacle, the receptacle having at least one pin extending therefrom, and at least one preset stone set in the receptacle. In the ring's unassembled state, the receptacle is detached from the base and in the ring assembled state, the pin is inserted through the opening and folded under the base, so that the receptacle is fixed to the base.

Additionally, in accordance with a preferred embodiment of the present invention, the diameter of the tip of the pin is smaller than the diameter of it base and at its other end, is generally equal or slightly greater than the diameter of the opening. The base forms an open volume in the internal side of the ring band, the folded pins occupy the volume, so that the pins do not contact a ring finger.

Furthermore, in accordance with a preferred embodiment of the present invention, there is provided a method for assembling a receptacle pin ring having a preset stone. The ring includes a base which forms part of a ring band and a receptacle separated therefrom. The base has at least one opening therethrough and the receptacle has at least one pin extending therefrom. The method includes setting the preset stone within the receptacle, inserting at least one pin in its corresponding opening of the base, and folding the pin under the base, so that the base is fixed to the receptacle.

Additionally, in accordance with a preferred embodiment of the present invention, the method for assembling a receptacle pin ring having a preset stone further includes providing a housing for supporting the receptacle while carrying out the inserting and folding steps. The method further provides a fixing tool for folding the at least one pin under the base. The fixing tool includes a "U"-shaped groove at one end thereof for gripping the pin.

BRIEF DESCRIPTION OF THE DRAWINGS

The present invention will be understood and appreciated more fully from the following detailed description taken in conjunction with the appended drawings in which.

DETAILED DESCRIPTION OF THE PRESENT INVENTION

Figure 1A:
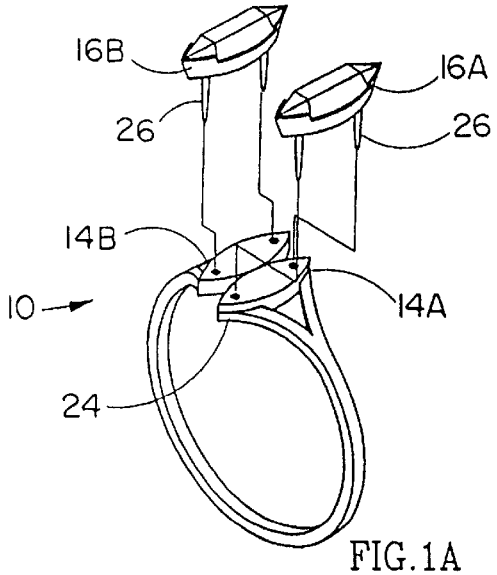
FIGS. 1A and 1B are schematic isometric illustrations of a ring constructed according to a preferred embodiment of the present invention in its unassembled and assembled states, respectively.
Figure 2A:
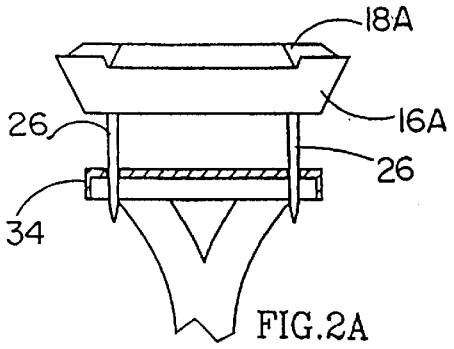
FIG. 2A–2C are schematic cross sections of the preset stone and receptacle of the ring of FIGS. 1A and 1B before assembly, during assembly and after assembly.
Figure 2B:
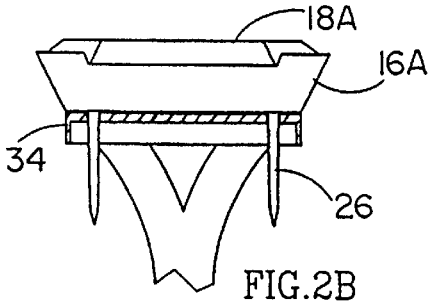
Figure 1B:
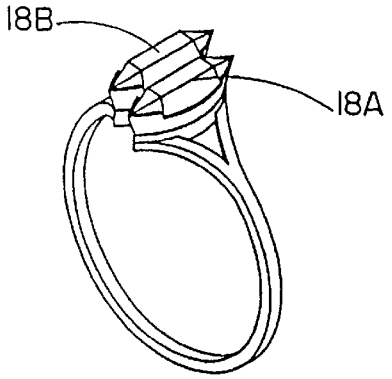
Figure 2C:
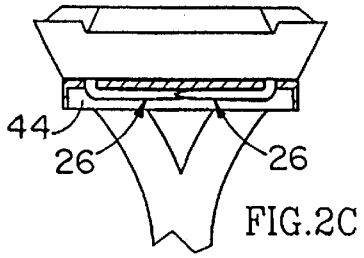

Reference is now made to FIGS. 1A–2C. FIGS. 1A and 1B illustrate a ring, generally referenced 10, constructed according to a preferred embodiment of the present invention, before assembly (FIG. 1A) and after assembly (FIG. 1B), and FIGS. 2A–2C are schematic cross section illustrations of the base and receptacle thereof before, during and after assembly, respectively.

The ring 10 comprises a ring band 12 and two bases, referenced individually 14A and 14B and collectively 14, which form one integral part. The ring 10 also comprises two separate receptacles, individually referenced 16A and 16B and collectively 16. The ring 10 further comprises two preset stones, referenced 18A and 18B and collectively 18.

It will be appreciated that the receptacles 16 with the preset stones 18 are illustrated herein by way of example and that the receptacle pin ring 10 may be purchased with any number of preset stones 18, each preset stone set within its receptacle 16 so as to provide the customer with a selection of stones which he can place and replace on the base 14 as described in detail hereinbelow.

The bases 14 have openings 24 therethrough (FIG. 1A) in which pins 26 extending from the receptacles 16 are inserted during the assembly of the ring 10 (FIG. 2A). As described in detail hereinbelow, during the assembly of the ring 10, the pins 26 are inserted in corresponding openings 24 so as to provide firm contact between the receptacle and the base (FIG. 2B) after which, the pins are folded under the base (FIG. 2C).

The diameter of the pins 26 is slightly smaller than that of the openings 24 and preferably, the pins 26 taper so as to form a conic shape with decreasing diameter from their base (the extension point from the receptacle 16) to their tip. This enables easy penetration of the tips of the pins 26 through the openings 24 and firm contact between the pin base and the opening 24 once the pin is pushed all the way through the opening 24. The firm contact is typically provided by a friction fit between the wide pin base and the opening 24.

One important aspect of the present invention is that a customer who desires to purchase a ring is not limited by the number and color preset stone combinations available in the store since the assemblage of the ring 10 is done by the retailer, salesperson or by the customer himself. Therefore, the ring 10 may be assembled with any combination of color preset stones selected from the stone inventory available at the retail shop.

According to a preferred embodiment of the present invention, the assembly of the ring 10 includes the following steps:

A. A preset stone 18 is selected for each receptacle 16 from a collection of preset stones available in the store or from a collection purchased by the ring owner. Common selections may include the favorite stone of a husband and wife, mother and son and the like or their birthstones.

B. The preset stones 18 are set in the receptacles 16 (FIG. 1A).

C. The pins 26 of the receptacle 16 are inserted into the corresponding openings 24 so as to obtain firm contact between the base 14 and the receptacle 16 (FIG. 2B).

D. The ring 10 is inverted with the receptacles 16 thereon. Because the receptacles 16 are firmly set into the base 14, they will not fall out when the ring 10 is inverted.

E. The pins are folded under the base (FIG. 2C) such that when the ring 10 is worn the pins are not seen. Preferably, the internal side of the base 14, i.e. the side facing the ring finger, is formed in the shape of an open box so as to form a volume 44 between the receptacle and the ring finger. As best seen in FIG. 2C, the folded pins reside in the volume 44 so as not to disturb the ring finger.

One advantage of the ring assembly method described hereinabove is that it may be done in a relatively short period of time and that the disassembly of the ring 10 is generally easy so as to facilitate replacement of the receptacles 16 as desired.

Figure 3A:
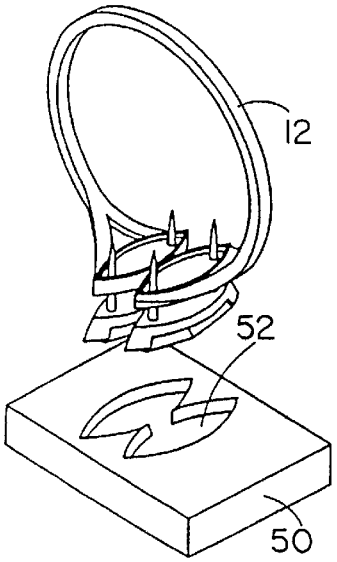
FIG. 3A–3C are schematic isometric illustrations of a ring assembly system according to a preferred embodiment of the present invention illustrating three stages of the assembly of the ring of FIG. 1B.
Figure 3B:
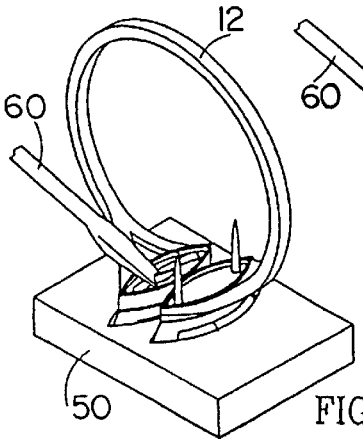
Figure 3C:
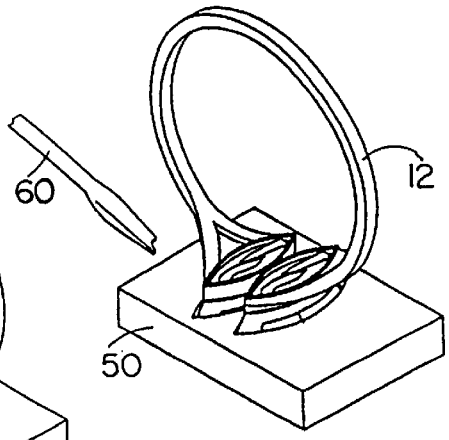

In order to facilitate the assembly of the ring 10, an assembly system illustrated in FIGS. 3A–3C may be provided. The ring assembly system includes a base 50 having a housing 52 (FIG. 3A), the shape of which is similar to that of the receptacle 16. During ring assembly, preferably after the stones are set in the receptacles 16, the pins 26 are inserted half way through the openings 24 (FIG. 3A) to ensure that the receptacle will not fall from the base 14. The ring is then positioned in the housing 52 so as to facilitate insertion of the pins 26 all way through openings 24 (FIG. 3B).

A fixing tool 60 having a "U"-shaped groove tip of corresponding shape to that of the pins 26 may by used to fold the pins under the base 14 in the volume 44.

Figure 4A:
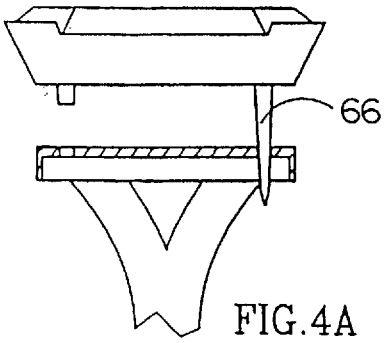
FIGS. 4A–4C are schematic cross sections of an alternative arrangement of the preset stone in its receptacle of FIGS. 1A and 1B before assembly, during assembly and after assembly, respectively.
Figure 4B:
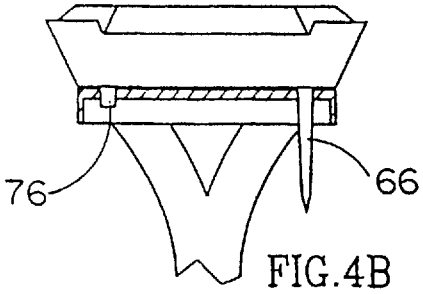
Figure 4C:
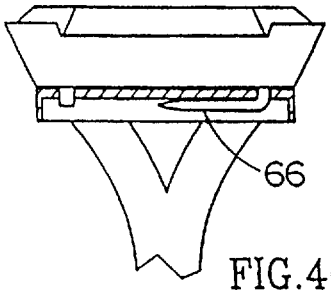

It will be appreciated that the present invention is not limited by what has been described hereinabove and that numerous modifications, all of which fall within the scope of the present invention, exist. For example, while the present invention has been described with respect to a receptacle having two pins, the present invention equally applies to a having a single pin or two pins not of equal size. As illustrated in FIGS. 4A–4C, according to an alternative preferred embodiment of the present invention, only one pin 66 extends through the opening 24 while a second pin 76 is inserted in the opening 24 so as to keep the receptacle 16 from moving relative to the base 14.

It will be appreciated by persons skilled in the art that the present invention is not limited by what has been particularly shown and described herein above. Rather the scope of the invention is defined by the claims which follow:

I claim:

1. A piece of jewelry comprising:

a base assembly having at least one base with at least two spaced apart openings therethrough;

at least one ornamental member, and said ornamental member comprising a pair of elongate pins extending therefrom, said pins having a generally curved cross-section at least a portion thereof, and said pins having generally the same length, wherein when said piece of jewelry is in an unassembled state, said ornamental member is detached from said base, and wherein said pair of pins of said ornamental member is spaced in corresponding relation to the spaced apart openings of said base, said pins being insertable in a said pair of openings and being foldable when so inserted through said openings to a folded relation facing towards each other, thereby firmly fixing said ornamental member to said base thereby constituting an assembled piece of jewelry;

wherein the length of each pin of said pair of pins is at least half the distance between said pair of pins and wherein said pins in said folded condition are folded in side by side relation.

2. The piece of jewelry of claim 1, wherein the at least one ornamental member contains at least one jewel.

3. The piece of jewelry of claim 1, wherein the length of each pin of said pair of pins is greater than half the distance between said pair of pins and in said folded condition said pins are in side by side overlapping confrontational relation.

4. The piece of jewelry of claim 1, wherein the one base of the base assembly has a recessed hollow area for containing said pins in folded and recessed relation.

5. The piece of jewelry of claim 1, wherein the one base of the base assembly has a substantially flat top surface and said ornamental member has a substantially flat bottom surface, said bottom surface being in face to face abutting contact engagement with said top surface when said piece of jewelry is in an assembled state.

6. The piece of jewelry of claim 1, wherein the one base of the base assembly has a recessed hollow area for containing said pins in folded and recessed relation.

7. The piece of jewelry of claim 1, wherein the one base of the base assembly has a substantially flat top surface and said ornamental members has a substantially flat bottom surface, said bottom surface being in face to face abutting contact engagement with said top surface when said piece of jewelry is in an assembled state.

8. The piece of jewelry of claim 1, said openings in said base being of curved cross section taken about an axis extending generally through the openings in the direction of insertion of a pin therein for cooperation with the curved cross section areas of respective pins.

9. The piece of jewelry of claims 1, wherein said pins have a generally circular cross section.

10. The piece of jewelry of claim 1, wherein said pins have a generally conical shape.

11. The piece of jewelry of claim 1, wherein the ornamental member has a base, and wherein said pins extend from the base of said ornamental member, and the top of said pins is smaller than the diameter of said pins proximate the base of the ornamental member.

12. The piece of jewelry of claim 1, wherein the ornamental member has a base, and wherein said pins extend from the base of said ornamental member, and the cross section of said pins proximate said base of said ornamental member is about the same as the size of the openings in said base of said base assembly and provide an interference fit therebetween.

13. The piece of jewelry of claim 1, wherein the base assembly includes a second base with at least two spaced apart openings therethrough and wherein the piece of jewelry comprises another ornamental member, said second ornamental member containing a pair of elongate pins extending therefrom.

14. An article of jewelry comprising a base and an ornamental member attached to the base when the article is in an assembled state and detached from the base when the article is in a disassembled state;

the base having at least two spaced apart openings therethrough;

the ornamental member comprising a decorative portion and at least two elongate pins extending therefrom which are spaced in corresponding relation to the spaced apart openings in the base and which each have a generally curved cross-section at at least a portion thereof;

the two pins are inserted into respective ones of the two openings and folded towards each other in a side-by-side folded condition when the article of jewelry is in its assembled state thereby firmly fixing the ornamental member to the base;

the length of each of the two pins is such that when they are in the folded condition at least a portion of one pin overlaps at least a portion of the other pin.

15. An article of jewelry as set forth in claim 14 wherein the length of each of the pins is at least half the distance between the openings in the base.

16. An article of jewelry as set forth in claim 14 wherein the base has a substantially flat top surface and the decorative portion of the ornamental member has a substantially flat bottom surface and wherein the base's top surface is in face-to-face abutting contact engagement with the ornamental member's bottom surface when the article of jewelry is in the assembled state.

* * * * *